US006960158B2

(12) United States Patent
Mackel

(10) Patent No.: US 6,960,158 B2
(45) Date of Patent: Nov. 1, 2005

(54) CENTRIFUGAL SEPARATOR

(75) Inventor: Wilfried Mackel, Oelde (DE)

(73) Assignee: Westfalia Separator AG, Oelde (DE)

( * ) Notice: Subject to any disclaimer, the term of this patent is extended or adjusted under 35 U.S.C. 154(b) by 127 days.

(21) Appl. No.: 10/478,173

(22) PCT Filed: May 23, 2002

(86) PCT No.: PCT/EP02/05664

§ 371 (c)(1),
(2), (4) Date: Dec. 8, 2003

(87) PCT Pub. No.: WO02/096566

PCT Pub. Date: Dec. 5, 2002

(65) Prior Publication Data

US 2004/0142808 A1 Jul. 22, 2004

(30) Foreign Application Priority Data

May 26, 2001 (DE) ..... 101 25 808

(51) Int. Cl.[7] ..... B04B 9/14
(52) U.S. Cl. ..... 494/82
(58) Field of Search ..... 494/1, 12, 16, 494/20, 82–84, 180; 210/144, 363; 464/180; 74/572, 574; 68/23.1, 23.3

(56) References Cited

U.S. PATENT DOCUMENTS 1,649,346 A * 11/1927 Grimble et al. ..... 494/83
2,487,343 A * 11/1949 Kopf ..... 384/535
2,534,738 A * 12/1950 Scott ..... 384/196
2,725,188 A * 11/1955 Scott ..... 494/38
2,827,229 A * 3/1958 Blum ..... 494/16
3,003,831 A * 10/1961 King et al. ..... 384/536
3,606,143 A * 9/1971 Stallmann ..... 494/39
3,692,236 A * 9/1972 Livshitz et al. ..... 494/20
3,804,324 A * 4/1974 Sinn et al. ..... 494/14
4,079,882 A * 3/1978 Mizuyoshi et al. ..... 494/60
4,099,667 A * 7/1978 Uchida ..... 494/7
4,193,536 A * 3/1980 Kubota ..... 494/14
4,334,718 A * 6/1982 Hirt et al. ..... 310/90.5
4,457,745 A * 7/1984 Broker et al. ..... 494/15
4,910,502 A * 3/1990 Serveau et al. ..... 340/683
5,199,937 A * 4/1993 Wada et al. ..... 494/7
5,800,070 A * 9/1998 Nilsson et al. ..... 384/535

(Continued)

FOREIGN PATENT DOCUMENTS

DE 31 258 32 C2 1/1983

(Continued)

*Primary Examiner*—Charles E. Cooley
(74) *Attorney, Agent, or Firm*—Milde & Hoffberg, LLP

(57) ABSTRACT

The invention relates to a centrifugal separator (100) comprising a centrifugal frame (40), a rotatable, vertically arranged, drive spindle (100) provided with a drum (12), and a motor (90) having a vertical rotor axis (91). The spindle (10) is rotatably mounted in a bearing pot (20) and is mounted in a manner that permits it to three-dimensionally move about a pivot (G) in relation to the centrifugal frame (40). The housing of the motor (90) is rigidly fixed to the centrifugal frame (40), with the rotor axis (91) of the motor (90) aligned with the longitudinal axis (11) of the drive spindle (10) when at rest. The motor rotor is connected to the spindle (10) at a coupling point (K) via a flexible coupling element (70). The spindle (10) is mounted in the bearing pot (20) at at least two interspaced bearing points (22, 24) by means of antifriction bearings. The bearing pot (20) is joined to the centrifugal frame (40) via elastic bearing elements (50).

5 Claims, 3 Drawing Sheets

U.S. PATENT DOCUMENTS

Figure 1:
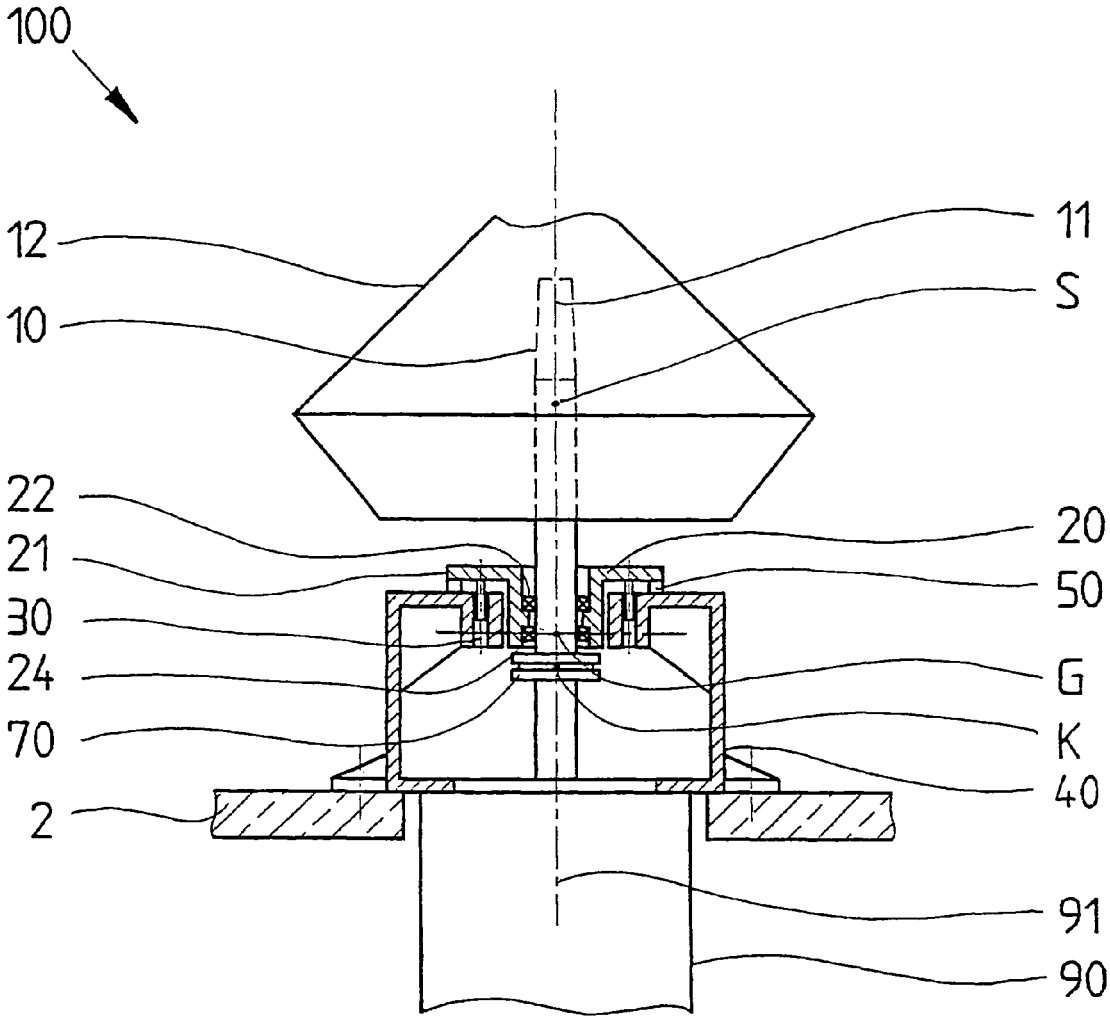

| | | | | | |
|---|---|---|---|---|---|
| 5,848,959 | A | * | 12/1998 | Droste et al. | 494/15 |
| 6,039,869 | A | * | 3/2000 | Dudley | 210/232 |
| 6,132,354 | A | * | 10/2000 | Ohtsu et al. | 494/16 |
| 6,149,571 | A | * | 11/2000 | Okada et al. | 494/20 |
| 6,224,533 | B1 | * | 5/2001 | Bengtsson et al. | 494/82 |
| 6,338,708 | B1 | * | 1/2002 | Miura et al. | 494/82 |
| 6,354,988 | B1 | * | 3/2002 | Carson et al. | 494/82 |
| 6,428,460 | B1 | * | 8/2002 | Appelquist et al. | 494/82 |
| 6,638,203 | B2 | * | 10/2003 | Carson et al. | 494/82 |
| 2004/0138041 | A1 | * | 7/2004 | Konno et al. | 494/84 |
| 2004/0142808 | A1 | * | 7/2004 | Mackel | 494/82 |

FOREIGN PATENT DOCUMENTS

| | | | | |
|---|---|---|---|---|
| DE | 37 146 27 | A1 | | 11/1987 |
| DE | 43 14 440 | C1 | | 5/1993 |
| DE | 19516904 | A1 | * | 11/1996 |
| EP | 0311791 | A2 | * | 4/1989 |
| JP | 9-10631 | | * | 1/1997 |
| WO | 01/08807 | A1 | * | 2/2005 |

* cited by examiner

CENTRIFUGAL SEPARATOR

BACKGROUND OF THE INVENTION

The invention relates to a centrifugal separator with a centrifuge frame, a rotatable, vertically-positioned spindle with a drum mounted on it, and a motor whose rotational axis is positioned vertically, whereby the spindle is supported in a bearing pot so that it may rotate and may be suspended from a pivot point connected to the frame that may move through three dimensions.

Such a centrifugal separator is known from U.S. Pat. No. 2,827,229. In this, the rotor and the frame are connected with each other via an elastic element that allows oscillation of the rotor. However, the rotor may also deviate radially because of the elasticity of the element so that, in addition to the circular motion, unforeseeable relative motions of the rotor axis in the bearing plane are possible.

Such a centrifugal separator is also known from The German Patent No. DE 31 25 832. In this, the crucial point of the suspended drive components coincides with the pivot that is in the area of the solitary bearing. The rotating unit consisting of spindle and drum is supported in a bearing pot via roller bearings so that it may rotate. The bearing pot including the rotating unit is suspended in the centrifuge frame. For this, slot bushings or the like are recommended that allow angular deviation of the rotation axis from the vertical. The mass action of the spindle is reduced by a large factor because of this design configuration. Drums with significantly larger weight and drums driven at different speeds may be used. A high degree of stability results from the short spindle. The known centrifuge is belt-driven, however. The belt is a wear part requiring a higher degree of maintenance. Slippage in the drive belt leads to losses in drive output. Since the friction heat from the slippage can no longer be radiated from the frame to the environment, the frame's heat increases. This known separator with a belt drive is therefore undesirable in many explosive environments. Also, the transferable drive output is limited.

The German Patent No. DE 37 14 627 A1 discloses a centrifugal separator in which the motor is directly connected to the spindle. The centrifuge drum, the spindle, and the motor together form a suspended unit that is so supported via two bearings that pendular motion about a pivot in the area of a lower bearing is possible. The upper bearing is connected with the frame via elastic elements, and thus allows spindle excursion during centrifuge operation. The forces acting on the upper bearing are thus reduced. A disadvantage of this configuration is that the lower bearing must also function as a revolving joint, thus requiring special implementation of roller bearings. The size and weight of the motor, and thereby also the motor output, is thus limited by the motor suspended with the spindle and drum.

The German Patent No. DE 43 14 440 C1 discloses another centrifugal separator in which the drive spindle, the drum, and the motor rotor are firmly connected with one another and form a rotating system that is supported elastically in a bearing bracket. The bearing bracket and the motor stator are connected together elastically with the centrifuge frame. The rotating system is suspended from a pivot during centrifuge operation. The known design for heavy motors with high output is not suitable because of the inertial forces and bearing loads that must be handled.

The principal objective of the present invention, therefore, is to provide a centrifugal separator that may be used in an explosive environment and with high output standard motors.

SUMMARY OF THE INVENTION

This objective, as well as other objectives which will become apparent from the discussion that follows, are achieved, in accordance with the present invention, by providing a centrifugal separator having a centrifugal frame, a rotatable, vertically arranged, drive spindle provided with a drum, and a motor having a vertical rotor axis. The spindle is rotatably mounted in a bearing pot and is mounted in a manner that permits it to three-dimensionally move about a pivot (G) in relation to the centrifugal frame. The housing of the motor is rigidly fixed to the centrifugal frame, with the rotor axis of the motor aligned with the longitudinal axis of the drive spindle when at rest. The motor rotor is connected to the spindle at a coupling point (K) via a flexible coupling element. The spindle is mounted in the bearing pot at at least two interspaced bearing points by means of antifriction bearings. The bearing pot is joined to the centrifugal frame via elastic bearing elements.

An advantage of this configuration is that the motor is decoupled from the rotational motion of the spindle and drum. The flexible elastic coupling element between spindle and drum can compensate angular displacement and minor radial displacement between the axes so that no strong flex load of the motor shaft and motor rotor bearing arises. Thus, low-cost use of standard motors is possible. The mass of the suspended system and of the motor mass is reduced by the fixed mounting of the motor to the centrifuge frame, and it is possible to use heavy motors with high power output. Major losses of power output that might lead to warming of the frame no longer occur in the drive train because of the direct coupling of the motor to the spindle, so that the centrifuge based on the invention is basically suited for use in an explosive environment.

Suspension of the rotating system in a bearing pot that is connected via elastic support elements to the frame leads to the fact that angular displacement arises only between the bearing pot and the frame, while the angular displacement between the inner ring and outer ring of a particular bearing is greatly reduced. Thus, standard roller bearings may be used.

The rotating-axis inclination with respect to the vertical created during separator operation causes one of the elastic support elements positioned between the bearing pot and the frame to be compressed while the opposing one is stretched. This compression and stretching of support elements may result with the circular motion from distribution of a large number of support elements along the circumference of a collar of the bearing pot.

It is essential to the invention that the bearing pot with a bearing pot collar be mounted with at least three support elements on the centrifuge frame. Preferably, the bearing pot with a bearing pot collar is mounted on the centrifuge frame with at least three elastic support elements, and at least three guide pins parallel to the longitudinal axis are attached to the bearing pot collar, each of which engages in a compatible hole in the centrifuge frame and is positioned so that it may be deformed along the axial direction and/or may be be axially displaced into the holes. These guide pins may be displaced axially within the hole, or may at least be deformed to the point that a relative movement is possible between the bearing pot collar and frame along the longitudinal axis. While the support elements positioned between the bearing pot collar and the upper side of the centrifuge frame accept the axial forces, the bearing pot is additionally set by the guide pins along the axial direction. It is thus possible that the rotating bearing pot inclines obliquely with the circular motion of the drum and spindle and then again rights itself, and thus maintains a defined position with respect to the centrifuge frame. The pivot thus always essentially lies along the longitudinal axis and does not deviate radially.

For a full understanding of the present invention, reference should now be made to the following detailed description of the preferred embodiments of the invention as illustrated in the accompanying drawings.

FIG. 1 is a first exemplary embodiment of the centrifugal separator of the invention in schematic cutaway view.

FIG. 2*a* is a second exemplary embodiment of the centrifugal separator of the invention, also in cutaway view.

Figure 2:
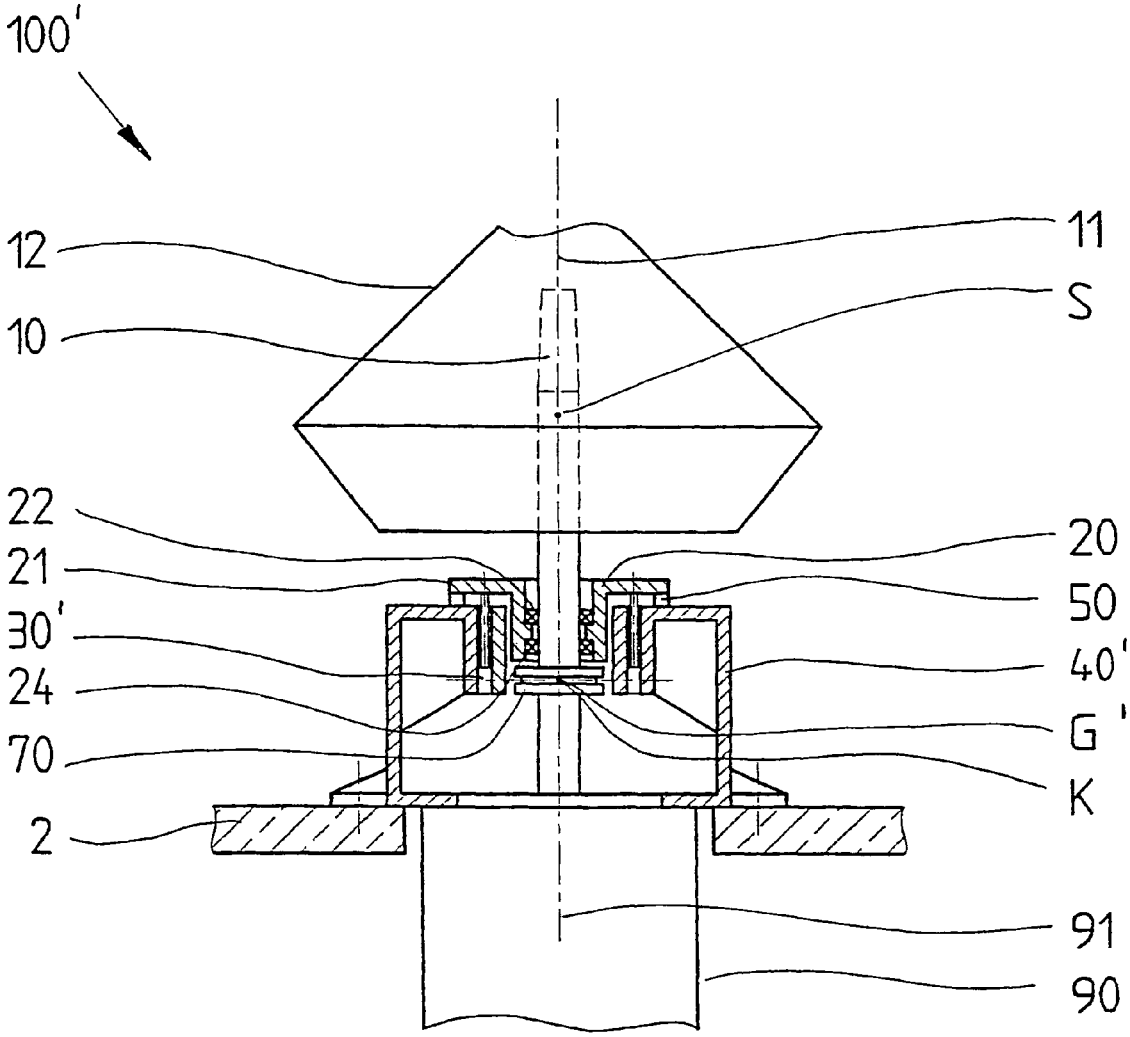
Figure 3A:
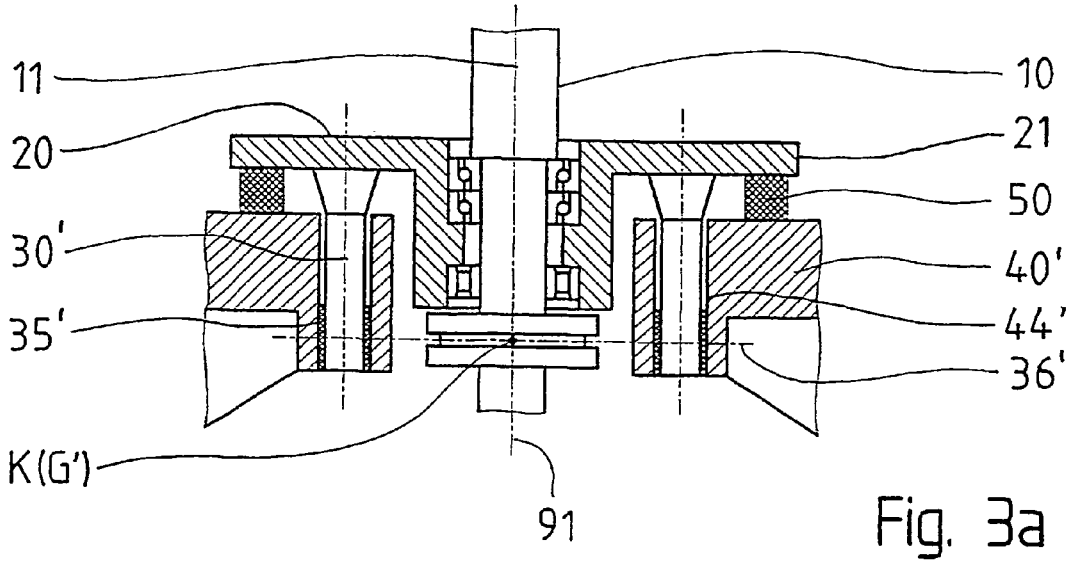
Figure 3B:
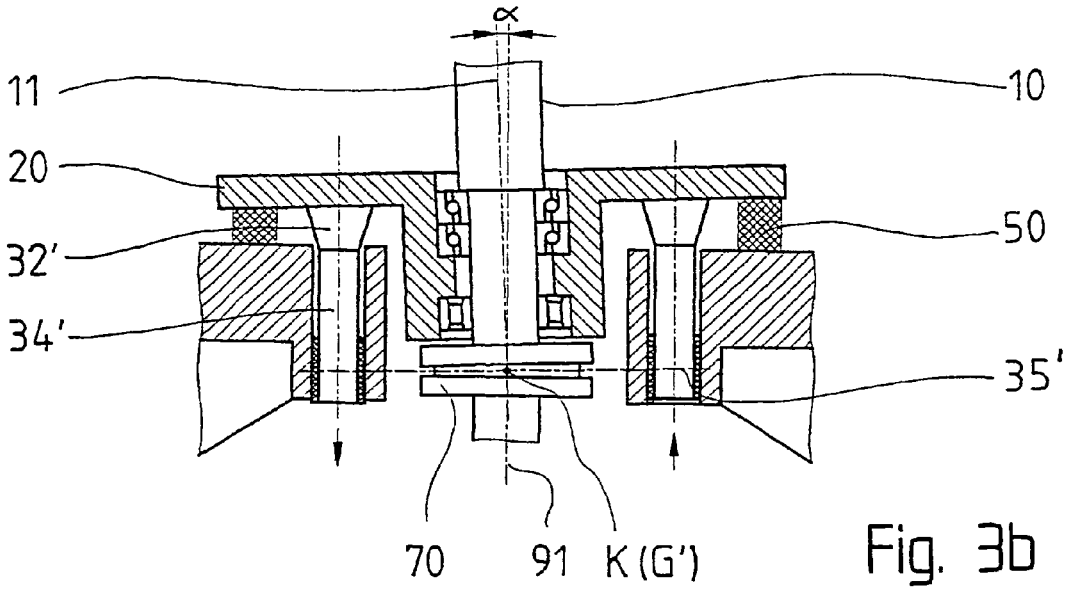

FIGS. 3*a* and 3*b* show the bearing pot as in the embodiment of FIG. 2 in various angular positions in cutaway view.

DESCRIPTION OF THE PREFERRED EMBODIMENTS

The preferred embodiments of the present invention will now be described with reference to FIGS. 1–3*b* of the drawings. Identical elements in the two figures are designated with the same reference numerals.

FIG. 1 shows a centrifugal separator 100 in a complete cutaway view. A motor 90 is secured to the underside of a centrifuge frame bolted to a base 2. A bearing pot 20 is installed into the upper side of the frame 40 that is supported by elastic support elements 50 and held by guide pins 30. A vertically-oriented spindle on which a drum 12 is placed is mounted so that it may rotate.

The spindle 10 is connected to the motor 90 via a flexible elastic coupling element 70. A slotted clutch bearing shell and a feather key may be provided for torque transmission. The longitudinal axis 11 of the spindle 10 and the rotor axis 91 coincide when the centrifugal separator 10 is at rest.

The bearing pot 20 particularly includes a bearing pot collar 21, an upper bearing 22, and a lower bearing 24. The spindle 10 is mounted in the bearings 22, 24 using roller bearings so that it may rotate.

A large number of bearing elements 50 are positioned between the upper side of the frame 40 and the lower side of the bearing pot collar 21 and are distributed about the circumference. Further, at least two guide pins 30 are provided that engage in compatible holes in the centrifuge frame 40. The guide pins 30 are elastically positioned so that they may be displaced radially but are largely inelastic to radial loads.

The spindle 10 is connected to the motor at coupling point K via the flexible elastic coupling element 70 so that angular displacement is allowed between the rotor axis 91 and the longitudinal axis 11 of the spindle 10 that may be attributed to the circular motion of the rotating system consisting of spindle 10 and drum 12. During this, the rotating system oscillates about the pivot G; the spindle axis 11 and the rotor axis 91 intersect at the pivot G. The coupling point K is slightly moved outward when the spindle 11 is oblique, whereby the shaft of the motor 90 also experience obliqueness. The coupling point K is positioned as close as possible to the pivot point G in order to keep the angular displacement to be compensated between spindle 11 and rotor axis 91 as small as possible, and thus to keep the load on the bearing in the motor 90 low.

The coupling 70 may further be so configured that a slight radial displacement between the axes 11 and 91 may be compensated. Additionally, a rotation-elastic configuration is possible in order distribute torque peaks during system operation.

It has proved to be particularly suitable if the distance between the coupling point K is 0.1 to 0.25 times the distance of the pivot point G to the center of mass S of the rotating system consisting of drum 12 and spindle 10. With this geometry, the load on the bearings of the motor 90 bolted to the frame 40 does not lead to significant shortening of the service life of the motor 90.

In another embodiment example of a centrifugal separator 100' that is shown in FIG. 2, the bearing points of the guide pins 30' are positioned so deep in the frame with respect to the coupling element 70 that the pivot G coincides with the coupling point K'. Thus, the obliqueness of the spindle 11 in operation can be compensated within the coupling element 70. During centrifuge operation, the coupling point also remains on the longitudinal axis 91 of the motor 90 so that the rotor axis 91 of the motor 90 does not deviate, and hardly receives any load from the circular motion of the rotating system.

FIGS. 3*a* and 3*b* show the direction of the bearing pot 20 with respect to the frame 40' in various positions of the embodiment example of the centrifuge 100' as in FIG. 2, in which the pivot point G' coincides with the coupling point K'.

The spindle 10 is supported at the bearing points 22, 24 within the bearing pot 20 using roller bearings, particularly angular-contact ball or roller bearings. The guide pins 30' are attached to the bearing pot collar. These include a conic section 32' and a cylindrical section 34' that is installed into a bushing 35'. The bushing 35' preferably surrounds an elastomer layer surrounded by an inner and an outer metal shell. The guide pin 30' is installed into a hole 44' in the frame. 40'. The guide pin 30' is supported rigidly over the bushing 35' radially, while a slight axial displacement of the guide pin 30' within the hole 44' is possible with an oblique setting of the bearing pot 20.

Further, several support elements 50 are provided between the frame 40' and the bearing pot collar 21 that preferably are made of elastomer materials. The weight forces of the rotating system are transferred from the spindle 10 via the fixed bearing pot 20 to the support elements 50 and then to the frame 40'.

In the initial position shown in FIG. 3*a*, the longitudinal axis 11 of the spindle 10 is positioned vertically, and the support elements 50 receive an equal axial load. A plane of symmetry 36' passes approximately at half height through the center point of the bearing shells 35'. The pivot G' or coupling point K lies at the intersection of the plane of symmetry 36' with the longitudinal axes 91 or 11.

FIG. 3*b* shows an obliqueness of angle $\alpha$ of the longitudinal axis 11 caused by the circular motion and forces of the rotating system consisting of drum, spindle 10, and the imbalance of the system, and the bearing pot 20 is rotated about the pivot point G by this angle. On the one side, a support element 50 between bearing pot collar 21 and frame 40' is compressed, and one on the other side is stretched. A return moment is created by the spring energy stored in the deformed elastomer support elements 50 that, together with the angular moment, causes righting of the rotating system.

The left guide pin is displaced downward with the obliqueness of the bearing pot 20 in FIG. 3*b*, while the right guide pin is lifted. The axial paths of the guide pins 30' are short since the guide pins are positioned with small radial separation from the pivot point G', and are preferably enabled by the elastic shape of the bushing 35'. It is achieved by the guide pins 30' that the bearing pot 20 is supported rigid radially so that the position of the pivot point g' remains largely constant with respect to the frame 40', and so that the bearing pot 20 on the other hand is flexible with respect to the obliqueness caused by the rotating system.

Since the pivot point G' and coupling point K coincide in the embodiment example of the centrifuge 100' per FIGS. 2, 3*a*, and 3*b*, the displacement by angle $\alpha$ is completely compensated within the coupling element 70 so that the rotor axis 91 maintains its position without change.

There has thus been shown and described a novel centrifugal separator which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Centrifugal separator with a centrifuge frame, a rotatable, vertically-positioned, drive spindle with a drum mounted on it and a motor whose rotor axis is vertically positioned, whereby the spindle is mounted in a bearing pot so that it may rotate, and is suspended from a pivot (G; G') with respect to the centrifuge frame so it is free to move in three dimensions;

wherein the housing of the motor is securely attached to the centrifuge frame, such that the rotor axis of the motor substantially coincides with the longitudinal axis of the drive spindle at rest;

wherein the rotor of the motor is connected at a coupling point (K) via flexible elastic coupling element to the spindle, and wherein the spindle is supported by at least two bearing points separated from each other by upper and lower bearings in the bearing pot; and wherein the bearing pot is connected with the centrifuge frame via elastic support elements;

wherein the bearing pot with a bearing pot collar is supported by at least three elastic support elements on the centrifuge frame, and wherein at least three guide pins, arranged parallel to the longitudinal spindle axis, are attached to the bearing pot collar, each of which engages in a compatible hole in the centrifuge frame and are positioned so that they may be deformed along the axial direction and/or may be axially displaced into the holes.

2. Centrifugal separator as in claim 1, wherein the pivot point (G; G') is located in the area of the plane of symmetry of the lower bearing.

3. Centrifugal separator as in claim 1, wherein the separation of the coupling point (K) from the pivot point (G) is 0.1 to 0.25 times the distance from the pivot point (G) to the center of mass (S) of the rotating system comprising said drum and spindle.

4. Centrifugal separator as in claim 1, wherein the coupling point (K) substantially coincides with the pivot point (G').

5. Centrifugal separator as in claim 4, wherein each of the guide pins is inserted in the hole through a bushing.

* * * * *